US007329441B2

(12) United States Patent
Catlin et al.

(10) Patent No.: US 7,329,441 B2
(45) Date of Patent: Feb. 12, 2008

(54) WATER-SOLUBLE POUCHES

(75) Inventors: Tanguy Catlin, Brussels (BE); Gwenael Delamarche, Auderghem (BE); David Ingram, Brussels (BE); Gisbert Spieles, Brussels (BE)

(73) Assignee: Procter & Gamble, Cincinnati, OH (US)

( * ) Notice: Subject to any disclaimer, the term of this patent is extended or adjusted under 35 U.S.C. 154(b) by 0 days.

(21) Appl. No.: 11/289,817

(22) Filed: Nov. 30, 2005

(65) Prior Publication Data

US 2006/0083876 A1 Apr. 20, 2006

Related U.S. Application Data

(63) Continuation of application No. 10/302,316, filed on Nov. 22, 2002, now abandoned.

(30) Foreign Application Priority Data

Nov. 23, 2001 (EP) ..... 01870256

(51) Int. Cl.

| | |
|---|---|
| ***B65D 65/42*** | (2006.01) |
| ***B65D 65/46*** | (2006.01) |
| ***B65D 85/00*** | (2006.01) |
| ***B65D 85/84*** | (2006.01) |

(52) U.S. Cl. ..... 428/35.2; 428/34.1; 428/34.4; 428/35.5; 428/35.7; 428/36.4; 428/36.92; 206/524.1; 206/524.3; 206/524.7

(58) Field of Classification Search ..... 428/34.1, 428/34.4, 34.5, 35.2, 35.4, 35.5, 35.6, 35.7, 428/36.4, 36.6, 36.92; 206/524.1, 524.3, 206/524.7

See application file for complete search history.

(56) References Cited

U.S. PATENT DOCUMENTS

| | | | | |
|---|---|---|---|---|
| 4,114,284 | A * | 9/1978 | Weber et al. | 34/390 |
| 4,416,791 | A * | 11/1983 | Haq | 510/296 |
| 4,514,425 | A * | 4/1985 | Rebhan | 426/93 |
| 4,629,645 | A * | 12/1986 | Inoue | 428/141 |
| 5,124,416 | A * | 6/1992 | Haruna et al. | 526/62 |
| 5,567,521 | A * | 10/1996 | Nishida et al. | 428/403 |
| 6,296,914 | B1 | 10/2001 | Kerins et al. | |

FOREIGN PATENT DOCUMENTS

| | | |
|---|---|---|
| EP | 0 338 350 A2 | 10/1989 |
| EP | 0 479 404 A2 | 4/1992 |

* cited by examiner

*Primary Examiner*—Rena Dye
*Assistant Examiner*—Walter B Aughenbaugh
(74) *Attorney, Agent, or Firm*—Julie A. McConihay; Kim William Zerby

(57) ABSTRACT

A water-soluble pouch, a process for producing a water-soluble pouch and the use of an electrostatically charged powder for coating film material are provided.

3 Claims, No Drawings

WATER-SOLUBLE POUCHES

CROSS REFERENCE TO RELATED PATENT APPLICATIONS

This application is a continuation application of U.S. patent application Ser. No. 10/302,316, filed Nov. 22, 2002 now abandoned which claims priority under 35 U.S.C. §119(a) to European Application Serial Number 01870256.3 filed Nov. 23, 2001, the disclosures of which are all incorporated by reference herein.

TECHNICAL FIELD

The present invention relates to water-soluble pouches and processes for their production.

BACKGROUND TO THE INVENTION

Pouch compositions are known in the art. These compositions have the advantage that they are easy to dose, handle, transport and store. Recently, water-soluble pouches containing cleaning or fabric care compositions have become popular. Usually the pouches are formed by placing two sheets of film together, sealing three edges, filling with the appropriate product, which is typically a gel or liquid, and then sealing the forth edge.

The film material used in water-soluble pouches is necessarily relatively fragile since it must release the product quickly, completely and without leaving residue. To achieve this, the film material must be thin and must have a high water-reactivity. This can lead to problems with the product being released prematurely due to the stresses of production, packing and transportation or due to exposure to a moist environment. In particular, it is difficult to stop the pouches from leaking small amounts of product, a process which is known as 'weeping'. A weeping pouch exhibits small quantities of the pouch contents on the film surface. Weeping causes the pouches to feel unpleasant to the touch. In addition, weeping pouches can contaminate the surface of other materials through physical contact.

The incorporation of powder into film material is known in the art. See, for example, JP-A-64/29438 (Kao) which describes a polyvinyl alcohol type film obtained by distributing an aqueous dispersion containing 5-30% by weight of a fine powder with a mean particle size of from 0.5-100 microns on one or both sides and then drying the film. The resultant film is said to have good slip properties and adhesion resistance. In addition, powdering of film material is known. See, for example, EP-A-338350 (Asahi) which describes a dusting treatment agent for imparting inter-film lubricity to a film of thermoplastic resin.

The Applicant has found that powdering the outside of the pouch greatly reduces the incidence of weeping. However, if the coating is uneven then it is less likely to reduce weeping. It is also important to minimize the amount of powder used in the pouch making process since it has cost, safety and environmental implications. In addition, consumers do not like water-soluble pouches on which they can feel powder.

The Applicant has surprisingly found that pouches coated with certain electrostatically charged powders show a reduced incidence of weeping. In addition, using such powders provides a more even coating to the film and minimizes the amount of powder used, and hence the above mentioned problems. While not wishing to be bound by theory it is believed that the charge attracts the powder to the film material making for a more even coating and reducing the amount of powder needed.

SUMMARY OF THE INVENTION

The present invention relates to water-soluble pouches comprising film material that is at least partially coated with an electrostatically charged powder. The present invention further relates to a process for producing water-soluble pouches, comprising water-soluble film material, wherein said film is at least partially coated with an electrostatically charged powder. The present invention also relates to the use of an electrostatically charged powder for coating film material.

DETAILED DESCRIPTION OF THE INVENTION

The present invention relates to water-soluble pouches comprising composition and film material that is at least partially coated with an electrostatically charged powder.

The pouch can be of any form, shape and material which is suitable to hold the composition, e.g. without allowing the release of the composition from the pouch prior to contact of the pouch to water. The exact execution will depend on, for example, the type and amount of the composition in the pouch, the number of compartments in the pouch, the characteristics required from the pouch to hold, protect and deliver or release the compositions. The pouch may be of such a size that it conveniently contains either a unit dose amount of the composition herein, suitable for the required operation, for example one wash, or only a partial dose, to allow the consumer greater flexibility to vary the amount used, for example depending on the size and/or degree of soiling of the wash load.

The pouches herein can comprise a single compartment or multiple compartments. If the pouch has multiple compartments, the different compartments can comprise the same composition or, more preferably, can comprise different compositions. A pouch typically contains less than 200 g of a cleaning or fabric care composition.

The pouches herein are preferably for use in an automatic dish-washer or fabric-washing machine.

Powder

The pouch material used herein must be at least partially coated with an electrostatically charged powder. A description of electrostatic charging can be found in Kirk-Othmer Encyclopedia of Chemistry Technology, 4th Edition.

The powders herein are preferably charged by acquiring a static charge from another charged object by induction. This is accomplished by direct charging, where the powder comes in contact with a conductor (electrode) at high voltage and an electrical charge, usually negative, is placed on the powder before atomization. Typically, an external voltage source of 20-125 kV, preferably 30-60 kV, is used. A voltage gradient is established between the vicinity of the atomizer and the grounded film material by using the charged coating particles, charged metal atomizer, or an electrode near the atomizer as a local source of a high voltage field. An electrostatic force is exerted on each powder particle equal to the product of the charge it carries and the field gradient. The trajectory of the particle is determined by all the forces exerted on the particle. These forces include momentum, drag, gravity, and electrostatics. The field lines influencing the coating particles are very similar in arrangement to the alignment of iron particles when placed between two magnets. Using this method, powder particles that would normally pass alongside the film material are attracted to it, and it is possible to coat part or all of the back side of the film material.

The key parameters which define whether a powder is suitable for electrostatic spray coating are Chargeability and Charge Relaxation Time. Chargeability is measured in Coulombs/kg and indicates the charge level which can be achieved for the powder. A powder with a chargeability of $1\times10^{-6}$ C/kg or more is considered suitable for electrostatic spray coating. Charge relaxation time is measured in seconds (s) and indicates how quickly a powder loses a charge. Less than 0.1 s is considered a fast charge relaxation time, more than 100 s is considered slow. Electrostatic properties of powders are typically determined by professional laboratories, such as Chilworth Technologies of Southampton, UK.

Preferred powders have an average particle size of from 0.5 μm to 50 μm. It is also preferred that the powder comprise less than 10% by weight of particles having a size of more than 100 μm. Particle size can be determined with a Laser Diffraction based Particle Size Analyzer "Mastersizer® Type S Long Bed 2.18" of Malvern Instruments, Malvern, England. This device uses laser diffraction technology to determine particle sizes and particle size distributions of fine powders. A small powder sample is fluidized with dry compressed air and conveyed through a screen into a detection cell where it is exposed to a laser light beam. The pattern of laser light scattering is characteristic for a particle size distribution. The Malvern software analyzes this pattern based on spherical particles and presents the result in the form of a Particle Diameter Histogram. The software also calculates the parameter D(v, 50) which is the particle size at which 50% of the sample is smaller and 50% is larger than this size. This parameter is also known as the mass median diameter (MMD)

It is preferred that the absolute particle density of the powder be from 500 g/l to 5,000 g/l as measured by Helium Pyconometry. Pyconometers measure density by calculating the difference in weight between the full and empty pycnometer and its known volume. For the purposes of the present invention the measurements can be made on an Accupyc 1330 Pycnometer (available from Microneritics, Norcross, Ga., USA).

It is preferred that the powders used herein have an absorption capacity between 10 and 500 g liquid or gel per 100 g powder. The adsorption capacity can be determined using ASTM D281-84/D234-82 ("Standard Test Method for Oil Absorption of Pigments by Spatula Rub-Out") using Linseed Oil as specified in ASTM D234-82 Standard Specification for Raw Linseed Oil.

Any suitable powder or mixtures of powders may be used herein. Preferred powders for use herein include native or modified starch (such as corn starch, potato starch or hydroxy ethyl starch), amylose, cyclodextrins, alumina, zinc oxide, zeolites (especially overdried zeolites), activated carbon, carbon molecular sieves, bentonite clays, and mixtures thereof. More preferred are amylose, zeolites, and mixtures thereof. Especially preferred are zeolites, and mixtures thereof.

In a preferred embodiment the powder herein comprises perfume. One issue associated with pouches is that the fragrance which is part of the cleaning or fabric care compositions does not penetrate the film and so the product does not have a distinctive odor or has the odor of the film material itself which is often not consumer acceptable. This issue can be overcome by using powder comprising perfume. This is of particular use when the powder has a 'pore' or 'cage' structure such as cylcodextrins or zeolites. The perfume is then trapped in the pore/cage and its release is consequently slowed so extending the period during which the odor of the film material is masked and the pouch retains its distinctive odor. In addition, powders comprising perfumes allow the formulator more flexibility in terms of scent, enabling him to have one scent before use and a different scent remaining on the washed items after use.

Zeolites and cyclodextrines can be loaded with perfumes to create Perfume Loaded Zeolites (PLZ) or Perfume Loaded Cyclodextrines (PLC). Small quantities can be prepared in a beaker of approx. 100 ml. A small quantity of powder is filled into this beaker, and the perfume is sprayed onto the powder. This process is exothermic and care has to be taken to control the rise in temperature which may reach 70° C. and more. Larger quantities of Perfume Loaded powders can be prepared by dosing powder and perfume into a mixer (continuous or batch), such as the Lödige KM or the Schugi mixer. Typically, this process results in a higher yield as less perfume is lost due to evaporation. The degree of loading and the retention level are based on the physicochemical properties, such as the molecular structure of the powder and the perfume, and the process conditions during loading, such as the mixing time and the mixing temperature. If necessary, additives, carriers or blockers can be used to increase the yield of the loading process and the retention level. Typical retention levels range from 10% to 70%. A more detailed description of a process for producing PLZ can be found in U.S. Pat. No. 5,648,328 (Procter & Gamble). A more detailed description of PLC can be found in U.S. Pat. No. 5,232,612 (Procter & Gamble).

Powdering Process

The charged powder can be applied to the pouch by any suitable means. In a preferred process the powder particles are given a negative charge and then these charged particles are directed to the pouches. Preferably, the powder coating operation is carried out in special spray booths. In a typical high voltage system, powder is maintained in a fluidized-bed reservoir, injected into an air stream, and carried to a charge gun where it is charged by passing through a corona discharge field. The charged powder is transported to the pouch or film material to be coated through a combination of electrostatic and aerodynamic forces. Preferably, the powder should be projected toward the pouch by aerodynamic forces so as to bring the powder particles close to the substrate where electrostatic forces then predominate and cause the particles to be deposited. Some of the powder is then held by electrostatic forces to the surface of the substrate. Therefore, the preferred pouch powdering process involves:

1. charging the powder,
2. transporting the powder to the pouch, and
3. enabling the adhesion of the powder to the pouch.

A preferred process involves charging the powder, especially zeolite, with an electrode is built into the powder spray. The resulting powder distribution on the pouch is very homogeneous. It is especially advantageous that the charged powder tends to adhere to both sides of the pouch so the side opposite to the spray gun is also coated. Also, it was found that in general the adhesion between charged powder and the pouch is stronger than the adhesion between uncharged powder and the pouch. This reduces the processing time and reduces powder losses in following processing steps. Multiple spray guns or multiple runs through a single spray gun may be used if it is desired to powder a particular pouch heavily.

A suitable coating system is the gun such as the Versa Spray II IPS Automatic Powder Spray Gun with the Versa Spray II IPS 2-Gauge Control Unit & coating booth available from Nordson Corporation, Westlake, Ohio, USA are available from Nordson Corporation, Westlake, Ohio, USA.

Film Material

It is preferred that the film used herein comprises material which is water-soluble. Preferred water-soluble films are polymeric materials, preferably polymers which are formed into a film or sheet. The material in the form of a film can for example be obtained by casting, blow-molding, extrusion or blow extrusion of the polymer material, as known in the art. Preferred water-dispersible material herein has a dispersability of at least 50%, preferably at least 75% or even at least 95%, as measured by the method set out hereinafter using a glass-filter with a maximum pore size of 50 microns. More preferably the material is water-soluble and has a solubility of at least 50%, preferably at least 75% or even at least 95%, as measured by the method set out hereinafter using a glass-filter with a maximum pore size of 50 microns, namely: Gravimetric method for determining water-solubility or water-dispersability of the material of the compartment and/or pouch:

5 grams±0.1 gram of material is added in a 400 ml beaker, whereof the weight has been determined, and 245 ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 50 micron). The water is dried off from the collected filtrate by any conventional method, and the weight of the remaining polymer is determined (which is the dissolved or dispersed fraction). Then, the percentage solubility or dispersability can be calculated.

The polymer can have any weight average molecular weight, preferably from about 1000 to 1,000,000, or even form 10,000 to 300,000 or even form 15,000 to 200,000 or even form 20,000 to 150,000.

Preferred film materials are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, polyvinyl alcohols, polyvinyl alcohol copolymers and hydroxypropyl methyl cellulose (HPMC), and mixtures thereof. Most preferred are polyvinyl alcohols. Preferably, the level of a type polymer (e.g., commercial mixture) in the film material, for example PVA polymer, is at least 60% by weight of the film.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000-40,000, preferably around 20,000, and of PVA or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1-35% by weight polylactide and approximately from 65% to 99% by weight polyvinyl alcohol, if the material is to be water-dispersible, or water-soluble. It may be preferred that the PVA present in the film is from 60-98% hydrolysed, preferably 80% to 90%, to improve the dissolution of the material.

Most preferred are films, which are water-soluble and stretchable films, as described above. Highly preferred water-soluble films are films which comprise PVA polymers and that have similar properties to the film known under the trade reference M8630, as sold by Chris-Craft Industrial Products of Gary, Ind., US and also PT-75, as sold by Aicello of Japan.

The water-soluble film herein may comprise other additive ingredients than the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful that the pouch or water-soluble film itself comprises a detergent additive to be delivered to the wash water, for example organic polymeric soil release agents, dispersants, dye transfer inhibitors.

It is preferred that the water-soluble film is stretched during formation and/or closing of the pouch, such that the resulting pouch is at least partially stretched. This is to reduce the amount of film required to enclose the volume space of the pouch. When the film is stretched the film thickness decreases. The degree of stretching indicates the amount of stretching of the film by the reduction in the thickness of the film. For example, if by stretching the film, the thickness of the film is exactly halved then the stretch degree of the stretched film is 100%. Also, if the film is stretched so that the film thickness of the stretched film is exactly a quarter of the thickness of the unstretched film then the stretch degree is exactly 200%. Typically and preferably, the thickness and hence the degree of stretching is non-uniform over the pouch, due to the formation and closing process. For example, when a water-soluble film is positioned in a mold and an open compartment is formed by vacuum forming (and then filled with the components of a composition and then closed), the part of the film in the bottom of the mold, furthest removed from the points of closing will be stretched more than in the top part. Preferably, the film which is furthest away from the opening, e.g. the film in the bottom of the mold, will be stretched more and be thinner than the film closest by the opening, e.g. at the top part of the mold.

Another advantage of using stretching the pouch is that the stretching action, when forming the shape of the pouch and/or when closing the pouch, stretches the pouch non-uniformly, which results in a pouch which has a non-uniform thickness. This allows control of the dissolution of water-soluble pouches herein, and for example sequential release of the components of the detergent composition enclosed by the pouch to the water.

Preferably, the pouch is stretched such that the thickness variation in the pouch formed of the stretched water-soluble film is from 10 to 1000%, preferably 20% to 600%, or even 40% to 500% or even 60% to 400%. This can be measured by any method, for example by use of an appropriate micrometer. Preferably the pouch is made from a water-soluble film that is stretched, said film has a stretch degree of from 40% to 500%, preferably from 40% to 200%.

Composition

Unless stated otherwise all percentages herein are calculated based on the total weight of the all the composition but excluding the film.

The pouches of the present invention can comprise a variety of compositions. Preferred are cleaning compositions, fabric care compositions, or hard surface cleaners. More preferably the compositions is a laundry, fabric care or dish washing composition including, pre-treatment or soaking compositions and other rinse additive compositions. The composition can be in any suitable form such as a liquid, a gel, a solid, or a particulate (compressed or uncompressed). Preferably the composition is a liquid or a gel.

If the composition is a liquid or gel, the total amount of water is preferably less than 25%, more preferably less than 10%, even more preferably from 1% to 8%, by weight of composition. This is on the basis of free water added to the composition.

The composition can made by any method and can have any viscosity, typically depending on its ingredients. The liquid/gel compositions preferably have a viscosity of 50 to 10000 cps (centipoises), as measured at a rate of 20 $s^{-1}$, more preferably from 300 to 3000 cps or even from 400 to 600 cps. The compositions herein can be Newtonian or non-Newtonian. The liquid composition preferably has a density of 0.8 kg/l to 1.3 kg/l, preferably around 1.0 to 1.1 kg/l.

In the compositions herein it is preferred that at least a surfactant and builder are present, preferably at least anionic surfactant and preferably also nonionic surfactant, and preferably at least water-soluble builder, preferably at least phosphate builder or more preferably at least fatty acid builder. Preferred is also the presence of enzymes and preferred may also be to incorporate a bleaching agent, such as a preformed peroxyacid. Highly preferred are also perfume, brightener, buffering agents, fabric softening agents, including clays and silicones benefit agents, suds suppressors, colorant or dye and/or pearlescence agent.

In hard-surface cleaning compositions and dish wash compositions, it is preferred that at least a water-soluble builder is present, such as a phosphate, and preferably also surfactant, perfume, enzymes, bleach.

In fabric enhancing compositions, preferably at least a perfume and a fabric benefit agent are present for example a cationic softening agent, or clay softening agent, anti-wrinkling agent, fabric substantive dye.

Highly preferred in all above compositions are also additional solvents, such as alcohols, diols, monoamine derivatives, glycerol, glycols, polyalkylane glycols, such as polyethylene glycol. Highly preferred are mixtures of solvents, such as mixtures of alcohols, mixtures of diols and alcohols, mixtures. Highly preferred may be that (at least) an alcohol, diol, monoamine derivative and preferably even glycerol are present. The compositions of the invention are preferably concentrated liquids having preferably less than 50% or even less than 40% by weight of solvent, preferably less than 30% or even less than 20% or even less than 35% by weight. Preferably the solvent is present at a level of at least 5% or even at least 10% or even at least 15% by weight of the composition.

Preferably the compositions herein comprise surfactant. Any suitable surfactant may be used. Preferred surfactants are selected from anionic, amphoteric, zwitterionic, nonionic (including semi-polar nonionic surfactants), cationic surfactants and mixtures thereof. The compositions preferably have a total surfactant level of from 0.5% to 75% by weight, more preferably from 1% to 60% by weight, most preferably from 40% to 55% by weight of total composition. Detergent surfactants are well known and described in the art (see, for example, "Surface Active Agents and Detergents", Vol. I & II by Schwartz, Perry and Beach). Especially preferred are compositions comprising anionic surfactants. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred. Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

The composition can comprise a cyclic hydrotrope. Any suitable cyclic hydrotrope may be used. However, preferred hydrotropes are selected from salts of cumene sulphonate, xylene sulphonate, naphthalene sulphonate, p-toluene sulphonate, and mixtures thereof. Especially preferred are salts of cumene sulphonate. While the sodium form of the hydrotrope is preferred, the potassium, ammonium, alkanolammonium, and/or $C_2$-$C_4$ alkyl substituted ammonium forms can also be used.

The compositions herein may contain a $C_5$-$C_{20}$ polyol, preferably wherein at least two polar groups that are separated from each other by at least 5, preferably 6, carbon atoms. Particularly preferred $C_5$-$C_{20}$ polyols include 1,4 Cyclo Hexane Di Methanol, 1,6 Hexanediol, 1,7 Heptanediol, and mixtures thereof.

The compositions preferably comprise a water-soluble builder compound, typically present in detergent compositions at a level of from 1% to 60% by weight, preferably from 3% to 40% by weight, most preferably from 5% to 25% by weight of the composition.

Suitable water-soluble builder compounds include the water soluble monomeric carboxylates, or their acid forms, or homo or copolymeric polycarboxylic acids or their salts in which the polycarboxylic acid comprises at least two carboxylic radicals separated from each other by not more that two carbon atoms, and mixtures of any of the foregoing. Preferred builder compounds include citrate, tartrate, succinates, oxydissuccinates, carboxymethyloxysuccinate, nitrilotriacetate, and mixtures thereof.

Highly preferred may be that one or more fatty acids and/or optionally salts thereof (and then preferably sodium salts) are present in the detergent composition. It has been found that this can provide further improved softening and cleaning of the fabrics. Preferably, the compositions contain 1% to 25% by weight of a fatty acid or salt thereof, more preferably 6% to 18% or even 10% to 16% by weight. Preferred are in particular $C_{12}$-$C_{18}$ saturated and/or unsaturated, linear and/or branched, fatty acids, but preferably mixtures of such fatty acids. Highly preferred have been found mixtures of saturated and unsaturated fatty acids, for example preferred is a mixture of rape seed-derived fatty acid and $C_{16}$-$C_{18}$ topped whole cut fatty acids, or a mixture of rape seed-derived fatty acid and a tallow alcohol derived fatty acid, palmitic, oleic, fatty alkylsuccinic acids, and mixtures thereof.

The compositions herein may comprise phosphate-containing builder material. Preferably present at a level of from 2% to 60%, more preferably from 5% to 50%. Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

The compositions herein may contain a partially soluble or insoluble builder compound, typically present in detergent compositions at a level of from 0.5% to 60% by weight, preferably from 5% to 50% by weight, most preferably from 8% to 40% weight of the composition. Preferred are aluminosilicates and/or crystalline layered silicates such as SKS-6, available from Clariant.

It is preferred that the compositions herein comprise perfume. Highly preferred are perfume components, preferably at least one component comprising a coating agent and/or carrier material, preferably organic polymer carrying the perfume or alumniosilicate carrying the perfume, or an encapsulate enclosing the perfume, for example starch or other cellulosic material encapsulate. Preferably the compositions of the present invention comprise from 0.01% to 10% of perfume, more preferably from 0.1% to 3%. The different compartments herein can comprise different types and levels of perfume.

The compositions herein can comprise fabric softening clays. Preferred fabric softening clays are smectite clays, which can also be used to prepare the organophilic clays described hereinafter, for example as disclosed in EP-A-299575 and EP-A-313146. Specific examples of suitable smectite clays are selected from the classes of the bentonites—also known as montmorillonites, hectorites, volchonskoites, nontronites, saponites and sauconites, particularly those having an alkali or alkaline earth metal ion within the crystal lattice structure. Preferably, hectorites or montmorillonites or mixtures thereof. Hectorites are most preferred clays. Examples of hectorite clays suitable for the present compositions include Bentone EW as sold by Elementis.

Another preferred clay is an organophilic clay, preferably a smectite clay, whereby at least 30% or even at least 40% or preferably at least 50% or even at least 60% of the exchangeable cations is replaced by a, preferably long-chain, organic cations. Such clays are also referred to as hydrophobic clays. The cation exchange capacity of clays and the percentage of exchange of the cations with the long-chain organic cations can be measured in several ways known in the art, as for example fully set out in Grimshaw, The Chemistry and Physics of Clays, Interscience Publishers, Inc., pp. 264-265 (1971). Highly preferred are organophilic clays as available from Rheox/Elementis, such as Bentone SD-1 and Bentone SD-3, which are registered trademarks of Rheox/Elementis.

The compositions herein preferably comprise a bleaching system, especially a perhydrate bleach system. Examples of prehydrate bleaches include salts of percarbonates, particularly the sodium salts, and/or organic peroxyacid bleach precursor, and/or transition metal bleach catalysts, especially those comprising Mn or Fe. It has been found that when the pouch or compartment is formed from a material with free hydroxy groups, such as PVA, the preferred bleaching agent comprises a percarbonate salt and is preferably free form any perborate salts or borate salts. It has been found that borates and perborates interact with these hydroxy-containing materials and reduce the dissolution of the materials and also result in reduced performance. Inorganic perhydrate salts are a preferred source of peroxide. Examples of inorganic perhydrate salts include percarbonate, perphosphate, persulfate and persilicate salts. The inorganic perhydrate salts are normally the alkali metal salts. Alkali metal percarbonates, particularly sodium percarbonate are preferred perhydrates herein.

The compositions herein preferably comprises a peroxy acid or a precursor therefor (bleach activator), preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein. The production of the organic peroxyacid occurs then by an in-situ reaction of the precursor with a source of hydrogen peroxide. The hydrophobic peroxy acid bleach precursor preferably comprises a compound having a oxy-benzene sulphonate group, preferably NOBS, DOBS, LOBS and/or NACA-OBS, as described herein. The hydrophilic peroxy acid bleach precursor preferably comprises TAED.

Amide substituted alkyl peroxyacid precursor compounds can be used herein. Suitable amide substituted bleach activator compounds are described in EP-A-0170386.

The compositions may contain a pre-formed organic peroxyacid. A preferred class of organic peroxyacid compounds are described in EP-A-170,386. Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

The compositions may also contain a bittering agent such as Bitrex to prevent intake by humans, colored powders to improve aesthetics, brighteners, and/or cyclodextrins.

Another preferred ingredient useful in the compositions herein is one or more enzymes. Suitable enzymes include enzymes selected from peroxidases, proteases, gluco-amylases, amylases, xylanases, cellulases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, dextranase, transferase, laccase, mannanase, xyloglucanases, or mixtures thereof. Detergent compositions generally comprise a cocktail of conventional applicable enzymes like protease, amylase, cellulase, lipase.

The compositions herein are preferably not formulated to have an unduly high pH. Preferably, the compositions of the present invention have a pH, measured as a 1% solution in distilled water, of from 7.0 to 12.5, more preferably from 7.5 to 11.8, most preferably from 8.0 to 11.5.

Process

The pouches herein can be produced by any suitable method. For example, the pouches can be formed by use of a die having series of molds and forming from a film that has been pre-powdered on the outside, open pouches in these molds to which product can be added and then the pouch is sealed. Another, process that can be used herein is the formation of pouches in molds present on the surface of a circular drum. Hereby, a film is circulated over the drum and pockets are formed, which pass under a filling machine to add product the open pockets. The pouch is then sealed. A preferred process for use herein is a horizontal, continuous process whereby a horizontally positioned portion of an endless surface with molds (in two dimensions), which moves continuously in one direction, is used to form the pouches, namely whereby a film is continuously fed onto this surface, and then, the film is drawn into the molds on the horizontal portion of the surface, to continuously form a web of open pouches positioned in horizontal position, to which product is added, whilst horizontal and whilst moving continuously. The pouch is then sealed, preferably whilst still horizontal and moving continuously.

The films may be drawn into the molds by any suitable method but are preferably drawn in by a vacuum which can be applied through vacuum ports in the mold.

The sealing can be achieved by conventional means such as heat-sealing but, preferably, is achieved by solvent-welding. As used herein the term "solvent-welding" refers to the process of forming at least a partial seal between two or more layers of film material by use of a solvent such as water. This does not exclude that heat and pressure may also be applied to form a seal. Any suitable solvent may be used herein. It is preferred that the solvent has a viscosity in the range 0.5 to 15,000 mPa.s, preferably from 2 to 13,000 mPa.s (measured by DIN 53015 at 20° C.). Preferred solvents for use herein comprise plasticiser, for example 1,2 propanediol, and water. A preferred sealing process involves applying solvent comprising plasticiser to the film and then applying heat and/or pressure. The temperature is preferably from 30° C. to 250° C., more preferably from 50° C. to 200° C. The pressure is preferably from 10 $Nm^{-2}$ to $1.5\times10^{7}$ $Nm^{-2}$, more preferbly 100 $Nm^{-2}$ to $1\times10^{5}$ $Nm^{-2}$.

EXAMPLE

A section of water-soluble, PVA based film with a thickness of 76 micrometer (PT-75 available form Aicello of Japan) was placed over the mold of a horizontal thermoforming machine. The molds were of a square shape with approximate dimension of 55 mm×55 mm. The film was drawn into the molds by a vacuum applied through vacuum ports in the mold. The film was carefully heated to facilitate its deformation. 52 ml of an essentially water-free, liquid cleaning composition are then added to the thermoformed film cavity. A second layer of film was then coated with a thin layer of a water-based solvent and placed above the filled cavities where it was sealed to the first layer of film.

The resultant pouches were subsequently treated with Zeolite A having a water content of 14% (available from Industrial Chemicals Ltd. of London, UK). The zeolite was filled into the hopper of a screw feeder (K-Tron Soder AG of Niederlentz/Switerland, feeder type 'S-200' with screw speed controller type LMC-0). The speed of the screw was set to a powder discharge rate of 0.5 kg/hr. At the outlet of the screw, a powder pump was installed to convey the powder from the screw to the powder spray gun (Versa Spray II IPS, Nordson). A pressure setting of 2.0 bar was used for the atomization air, a setting of 4.0 bar was used for the fluidization air. The powder spray gun was placed inside a ventilated booth (Nordson Inc. type Micromax) to ensure that no powder dust escaped. A mesh belt (Wirebelt Ltd, UK) with a pitch of 6 mm traversed the booth at a speed of 11 m/min. This belt was grounded to the same mass as the powdering booth. The powder gun was placed below the mesh belt, such that the powder was sprayed upwards. The distance between the belt and the top of the belt conveyor was about 110 mm. At the tip of the spray gun, a flat spray nozzle was fitted such that the plane of the powder spray is perpendicular to the direction of the belt. Pouches were then placed onto the belt at the feeding side such that the thermoformed side was in contact with the belt. They were then spray coated and collected at the discharge side of the belt. The weight of each individual pouch was measured before and after powdering to determine the quantity of powder applied. It was found that the quantity of powder depended strongly on the electrostatic charge which is applied to the electrode in the spray gun.

What is claimed is:

1. A water-soluble pouch, wherein the pouch comprises;

a) a water-soluble film at least partially coated by an electrostatically charged powder, said powder comprising particles of the powder; and b) said pouch comprising a laundry, fabric care or dish washing composition;

wherein less than 10% by weight of the particles of the powder have a size of more than 100 μm;

wherein the particles of the powder have an average particle size of from 0.5 μm to 50 μm; and wherein the powder (i) has a chargeability of $1\times10^{-6}$ C/kg or more, (ii) has an absorption capacity of between 10 and 500 g liquid or gel per 100 g powder and (iii) is homogeneously coated on the outside of said pouch.

2. A water-soluble pouch according to claim 1 wherein said powder is selected from amylose, zeolites, and mixtures thereof.

3. A water-soluble, pouch according to claim 1 wherein said powder further comprises a perfume.

* * * * *